US006186518B1

(12) United States Patent
Moses

(10) Patent No.: US 6,186,518 B1
(45) Date of Patent: Feb. 13, 2001

(54) SUSPENSION SYSTEM FOR INLINE SKATES

(75) Inventor: James D. Moses, Seattle, WA (US)

(73) Assignee: Sportsfx, Seattle, WA (US)

( * ) Notice: Under 35 U.S.C. 154(b), the term of this patent shall be extended for 0 days.

(21) Appl. No.: 09/290,378

(22) Filed: Apr. 12, 1999

(51) Int. Cl.[7] ..... A63C 17/00

(52) U.S. Cl. ..... 280/11.225; 280/11.231; 280/11.27; 280/11.223

(58) Field of Search ..... 280/842, 11.231, 280/11.223, 11.225, 11.27, 11.28, 87.041, 87.042, 787, 124.17

(56) References Cited

U.S. PATENT DOCUMENTS

| | | | |
|---|---|---|---|
| 2,644,692 | 7/1953 | Kahlert | 280/11.22 |
| 3,339,936 | 9/1967 | Hamlin | 280/11.2 |
| 3,963,252 | 6/1976 | Carlson | 280/11.22 |
| 4,272,090 | 6/1981 | Wheat | 280/11.22 |
| 4,272,091 | 6/1981 | Reid, Jr. | 280/11.28 |
| 5,085,445 | 2/1992 | Boyden | 280/11.22 |
| 5,135,244 | 8/1992 | Allison | 280/11.28 |
| 5,330,208 | 7/1994 | Charron et al. | 280/11.22 |
| 5,342,071 | 8/1994 | Soo | 280/11.22 |
| 5,393,078 | 2/1995 | Bourdeau | 280/11.22 |
| 5,405,156 | 4/1995 | Gonella | 280/11.28 |
| 5,503,413 | 4/1996 | Belogour | 280/11.22 |
| 5,536,025 | 7/1996 | Landay | 280/11.22 |
| 5,551,713 | 9/1996 | Alexander | 280/11.19 |
| 5,575,489 | 11/1996 | Oyen et al. | 280/11.22 |
| 5,582,418 | 12/1996 | Closser | 280/11.22 |
| 5,586,774 | 12/1996 | Dentale | 280/11.22 |
| 5,685,551 | 11/1997 | Zorzi | 280/11.22 |
| 5,690,344 | 11/1997 | Chen | 280/11.28 |
| 5,704,620 | 1/1998 | Oliemans et al. | 280/11.22 |
| 5,704,621 | 1/1998 | Lazarevich et al. | 280/11.28 |
| 5,709,396 | 1/1998 | Zorzi et al. | 280/11.28 |
| 5,791,665 | 8/1998 | Mayer, II | 280/11.22 |
| 5,816,588 | 10/1998 | Nicoletti | 280/11.22 |
| 5,823,543 | 10/1998 | Burns et al. | 280/11.22 |

FOREIGN PATENT DOCUMENTS

| | | | | |
|---|---|---|---|---|
| 439934 | * | 1/1927 | (DE) | 280/11.27 |
| 14037 | * | 10/1884 | (GB) | 280/11.27 |
| 1050723 | * | 10/1983 | (SU) | 280/11.28 |
| WO9312846 | * | 7/1993 | (WO) | 280/11.28 |

* cited by examiner

*Primary Examiner*—Brian L. Johnson
*Assistant Examiner*—Tony Winner
(74) *Attorney, Agent, or Firm*—Ronald M. Anderson

(57) ABSTRACT

A suspension system for use with inline skates. The suspension system employs a mounting bracket that supports a flex beam on a left side and a flex beam on a right side of the mounting bracket. Downwardly extending tabs formed at the ends of the flex beams are each connected to an axle on which one of a plurality of wheels is supported. In a preferred embodiment, four inline wheels are connected to the flex beams, such that the first and third wheels are attached to one flex beam and the second and fourth wheels are attached to the other flex beam. This configuration allows the end of each flex beam and the wheel mounted thereon to deflect vertically as well as laterally and about a longitudinal axis of the flex beam. An independent suspension system is thus provided for each wheel. The ends of the flex beams are tapered (in thickness) to control the resiliency of the flex beams.

30 Claims, 6 Drawing Sheets

SUSPENSION SYSTEM FOR INLINE SKATES

FIELD OF THE INVENTION

The present invention generally relates to a suspension system for inline skates, and more specifically, to a suspension system that incorporates a flexible beam to absorb shock and thereby increase the comfort to those skating over rough terrain.

BACKGROUND OF THE INVENTION

Inline skating has become a popular pastime, providing both a relaxing outdoor activity and exercise. Compared to earlier skates having two axles on which pairs of opposed wheels were mounted, inline skates used today are much more comfortable and safe. The wheels of inline skates are designed for outdoor usage and readily roll over surfaces that are not very smooth or free of debris. Early skates either had no suspension system, or at best, a very primitive suspension system. Modern inline skates employ wheels made of an elastomeric material that helps to absorb shock, but is not sufficient to absorb the shock of rough terrain, where sidewalk expansion strips, frost heaved sections, and pebbles can produce rather significant shocks to the skater's feet.

To help absorb such shock and enhance the performance and comfort of inline skates, certain inline skates have been designed with more sophisticated suspension systems. Prior suspension systems have included coil springs, elastomeric blocks, leaf springs, and hydraulic pistons. While such suspension systems can indeed enhance the performance of inline skates, they tend to interfere with the control exercised by the skater, don't provide sufficient shock absorption, or are too complex and expensive. Prior art suspension systems that include springs primarily permit vertical deflection of the wheels and are not readily tuned to accommodate skaters of differing weight. Furthermore, it would be desirable to employ a suspension system that allows for other modes of deflection other than in the vertical plane. From a manufacturing and cost consideration, it would be desirable to develop an effective suspension system for inline skates that is relatively simple, contains few parts, and is easy to manufacture. From the viewpoint of the user of inline skates, such inline skates should also be durable and should not interfere with the skating experience. Preferably, the suspension system should improve the comfort and the control of the skater, particularly while cornering. In addition, the suspension system should enable the skater to accelerate with greater force by unleashing stored energy as the skater pushes off from a mark.

SUMMARY OF THE INVENTION

The present invention provides a simple, yet effective suspension system that reduces the discomfort caused by inline skating over an uneven or rough surface. Additionally, the resiliency of the suspension system provides better control when cornering and aids the skater in pushing off and accelerating. As the skater exerts a downward force on the skate to move forward, the suspension system is deflected in response to the force of the skater's effort. When the skater releases the downward pressure, the suspension system returns the stored energy by providing additional thrust to move the skater forward, as the suspension system returns to its undeflected position.

In accord with the present invention, a suspension system for an inline skate is defined that includes a bracket adapted to attach to a boot, which receives a user's foot. A flex beam having a center and opposite ends extending longitudinally from the center is provided, and the center of the flex beam is connected to the bracket and supported thereby. Each end of the flex beam is adapted to connect with and support a wheel on an axle, so that the wheel can rotate. The ends of the flex beam deflect to absorb shock when a wheel supported by an end of the flex beam rolls over a bump.

Preferably, the system includes another flex beam like the one defined above. Again, each end of the other flex beam is adapted to connect with and support a wheel on an axle that enables the wheel to rotate. These two flex beams are disposed along opposite sides of the bracket, and the end of each flex beam deflects to absorb shock when a wheel supported by that end rolls over a bump.

In one preferred form of the invention, the flex beam is fabricated from a metal having predefined elastomeric properties. It is also preferable to taper the flex beam, so that it is thinner at each end to achieve a specified deflection for a defined force. The flex beam is also preferably removably coupled to the bracket using a fastener.

The ends of the flex beam deflect vertically and also may deflect laterally to absorb the shock of a wheel rolling over a bump. In addition, the flex beam deflects about its longitudinal axis when absorbing shock.

The bracket preferably has a side that depends downwardly, so that the flex beam is attached to the side of the bracket, along a lower edge. In one preferred form, the bracket is generally shaped like an inverted "U," with opposite sides. The two flex beams are then mounted to the opposite sides of the bracket, along the lower edges. Each side of the bracket includes a front edge and a rear edge that are angled towards each other along the bottom of the bracket. The angled edges provide clearance for deflection of the wheels. In addition, the flex beam includes a tab at each end in which an orifice adapted to accept an axle for supporting a wheel is provided.

A further aspect of the present invention is directed to a method for reducing shock and vibration transmitted to a skater when a wheel of an inline skate rolls over a bump. The method includes steps that are generally consistent with the elements of the system described above.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Figure 1:
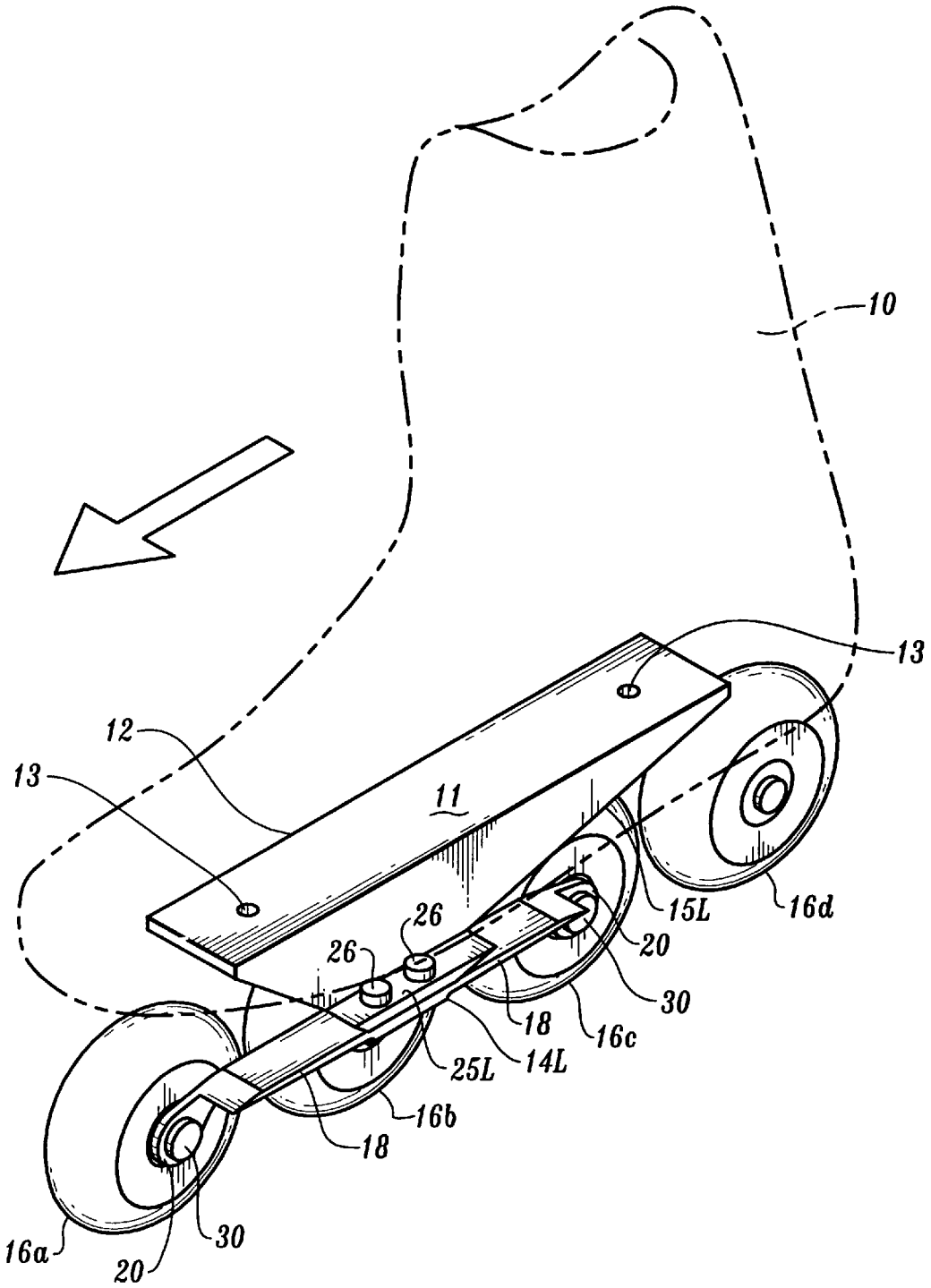
FIG. 1 is an isometric view of a preferred embodiment of the suspension system in accord with the present invention, shown in relation to an inline skate boot (depicted in phantom view)

FIGS. 1 through 5 illustrate a preferred embodiment of the present invention. The following discussion includes the terms left, right, front, rear and forward, which are consistent with the terms a person wearing the inline skate boot as in FIG. 1 would use to describe the inline skate and its orientation. Thus, "left" refers to the side to the left of the skater, "right" refers to the side to the right of the skater, "front" refers to the end of the skate leading in the direction in which the skater normally travels "forward" (as indicated by the large arrow in the drawings), and "rear" refers to the opposite end or direction.

In FIG. 1, the disposition of the suspension system is shown relative to a typical inline skate boot 10. A top surface 11 of a mounting bracket 12 includes orifices 13 that accept fasteners (not shown) for use in securing the mounting bracket to the sole of boot 10. The type of fastener used to affix boot 10 to mounting bracket 12 is not a critical feature of the present invention. In the preferred embodiment, the fasteners employed will likely permanently affix boot 10 to mounting bracket 12. Rivets, adhesive, molded constructs, or other permanent fastening means may be used for this purpose. It is also envisioned that removable fasteners such as screws, threaded bolts, or pins and clips can be used to connect boot 10 to mounting bracket 12. Use of removable fasteners for connecting boot 10 and mounting bracket 12 would allow either component to be replaced if desired.

Figure 4:
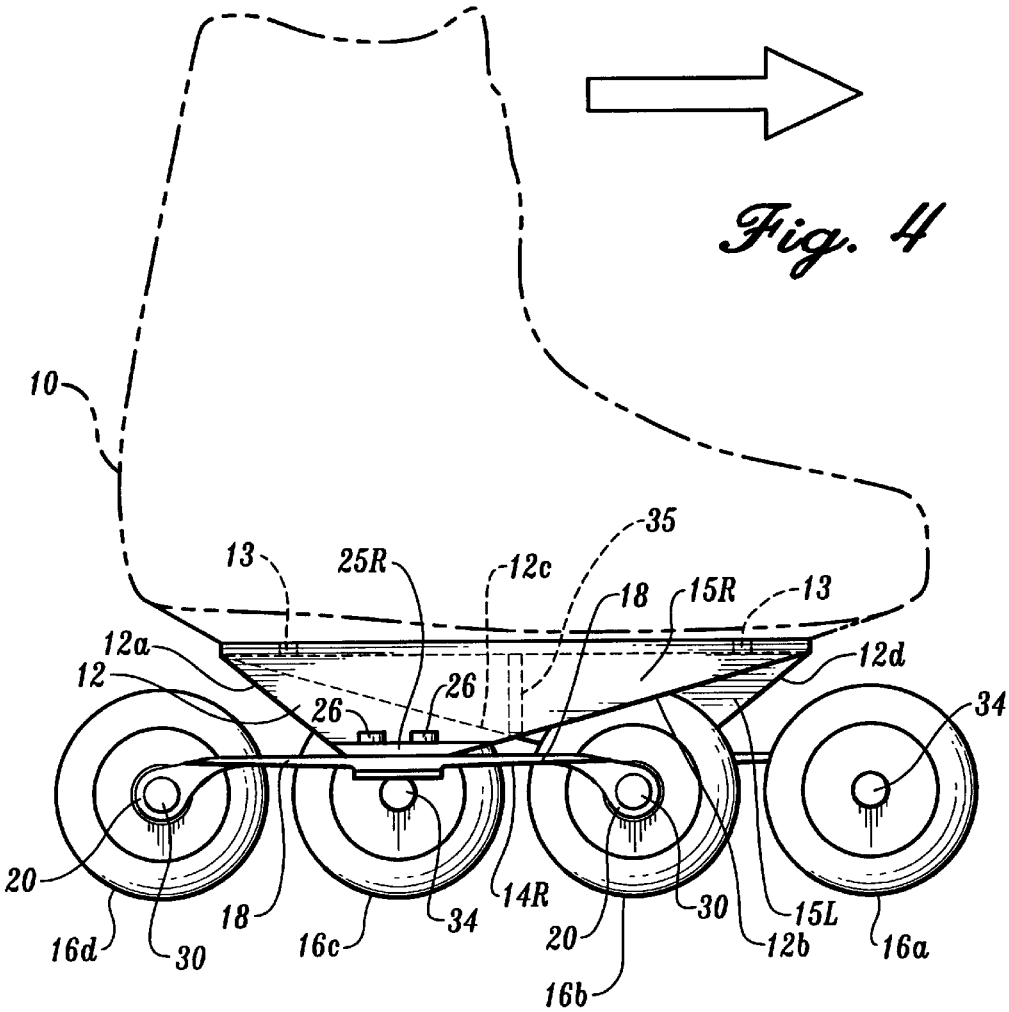
FIG. 4 is a side elevational view of the suspension system and wheels, in relation to a boot shown in phantom view.

Mounting bracket 12 is generally elongate, and when viewed from either end, appears to have an inverted "U" shape. The downwardly depending sides of the mounting bracket include a left side 15L, as shown in FIG. 1, and a right side 15R, as shown in FIG. 4. When viewed from the side as in FIG. 4, sides 15L and 15R are not congruent, but instead, may be described as being "complementarily asymmetrical," since each side is designed to support different pairs of wheels 16*a*/16*c*, and 16*b*/16*d*, respectively.

Figure 2:
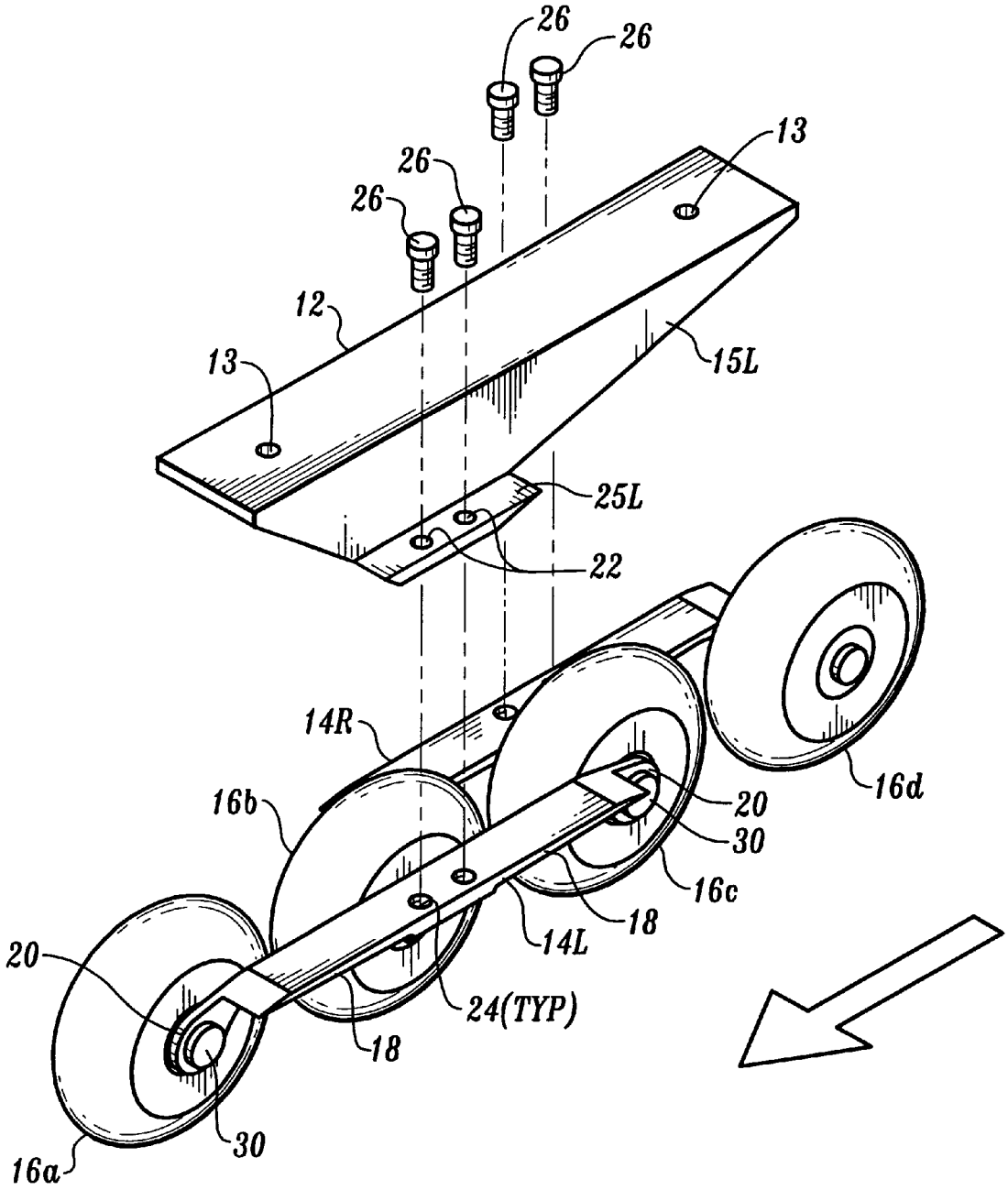
FIG. 2 is a partially exploded isometric view of the preferred embodiment of FIG. 1.
Figure 3:
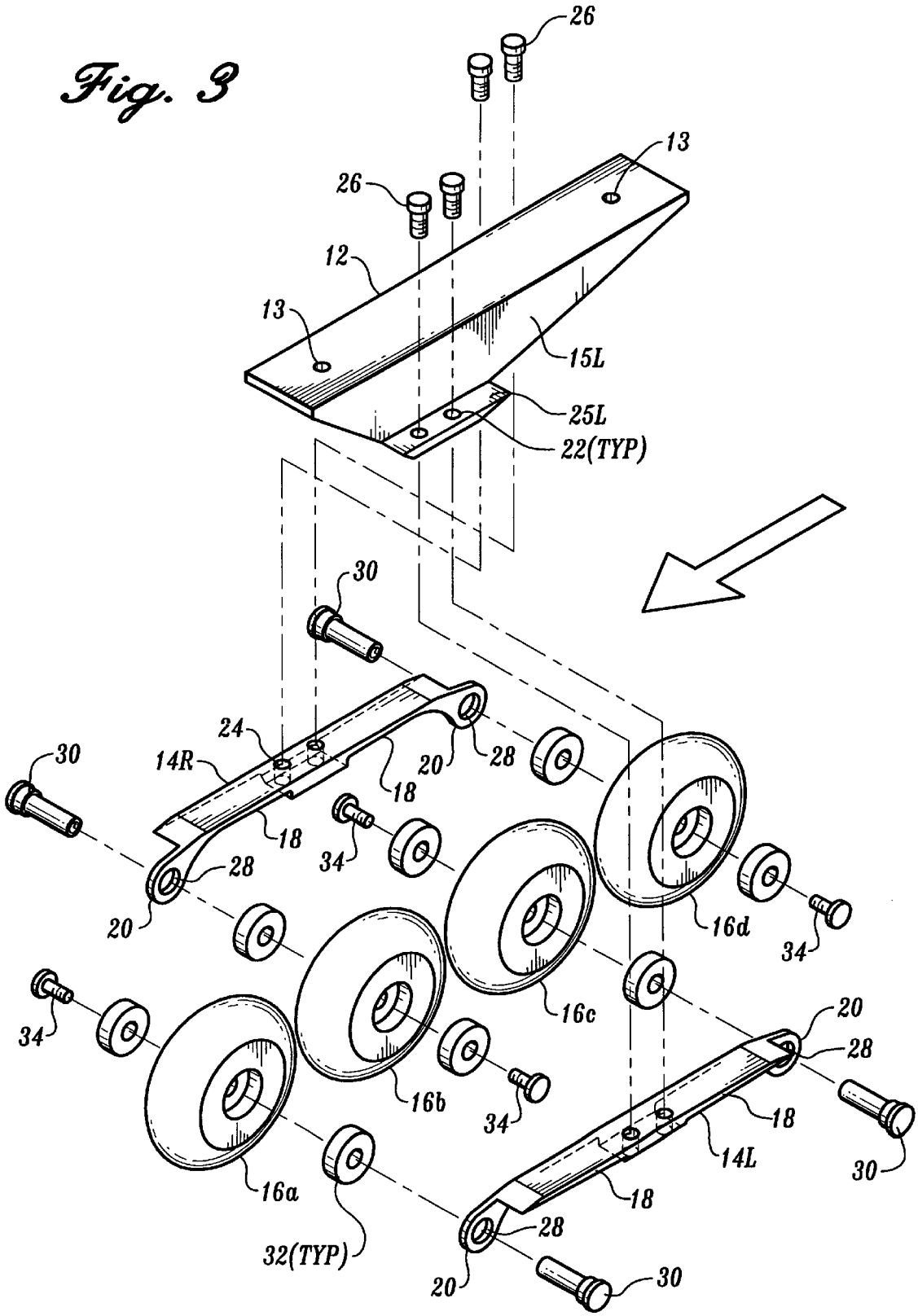
FIG. 3 is a fully exploded isometric view illustrating more details of the suspension system of the embodiment of FIGS. 1 and 2.
Figure 5:
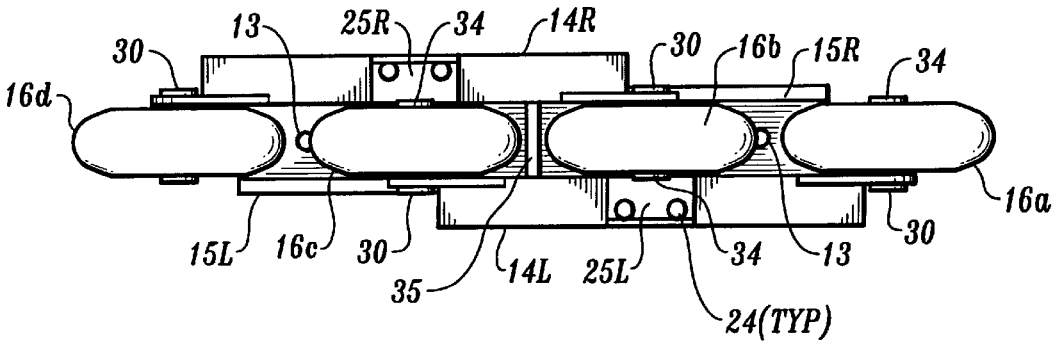
FIG. 5 is a bottom plan view of the suspension system and wheels.

Extending outwardly from the lower edge of side 15L is a beam bracket 25L. A similar beam bracket 25R extends outwardly from the lower edge of side 15R, as shown in FIG. 5. Beam bracket 25L is connected to a flex beam 14L, as shown in FIGS. 1–3, and beam bracket 25R is similarly connected to a flex beam 14R, using threaded fasteners 26, which extend through orifices 22 (shown in FIGS. 2–3) in the beam brackets and are threaded into threaded orifices 24 formed in the flex beams. Alternatively, other types of fasteners, including removable or permanent fasteners, such as rivets (not shown), can be readily used to couple the beam brackets to the flex beams, as will be appreciated by one of ordinary skill in the art.

Referring once more to FIG. 1, it will be noted that flex beam 14L comprises two tapered areas 18 in which the thickness of the flex beam changes (flex beam 14R includes identically tapered areas, as will be apparent in FIG. 3). Flex beam 14L is thickest in its center, where the flex beam is attached to beam bracket 25L. Moving both to the front and to the rear from the center of flex beam 14L, the thickness of flex beam 14L is gradually reduced along the length of tapered areas 18. Tapered areas 18 control the resiliency or flexure of flex beams 14L and 14R. Preferably, the flex beams are fabricated from a heat-treated stainless steel, but it is also contemplated that they may be made of fiber reinforced plastic or other suitable materials having the required strength and elasticity. The thickness of the flex beams and the degree of the taper in tapered areas 18 are selected to provide a desired amount of resiliency to the suspension system so that the flex beams deflect by a desired amount for a specific force. Tapering the thickness of the flex beams also ensures that more of the deflection of the flex beams occurs closer to the ends of the flex beams rather than at the center where the flex beams are attached to beam brackets 25L and 25R, respectively.

While flex beams 14L and 14R include tapered areas 18 in this preferred embodiment, it is envisioned that flex beams without tapered areas can alternatively be used. The suspension characteristics (the "softness" or "firmness" of the suspension) can be controlled by varying either the thickness of the flex beams or the degree and longitudinal extent of tapered areas 18. It is also contemplated that the flex beams may be configured to have an arcuate shape (i.e., with a concave side of the arcuate shaped flex beams facing downwardly) to provide yet another parameter for controlling the resiliency of the suspension system. It is also contemplated that inline skates will be provided with suspension systems that are appropriate for use by skaters of differing weight and skill level. A heavier skater will likely prefer a suspension system that is stiffer and deflects less for a given force than a lighter weight skater. In addition, a skater who is more experienced may also prefer a suspension system that is stiffer.

Adjacent to the thinnest section of each tapered area 18, flex beams 14L and 14R include tabs 20, which extend downwardly from the horizontal surface of the flex beams. A particularly important feature of the preferred embodiment of the invention is the manner in which tabs 20 of flex beams 14L and 14R are connected to the plurality of wheels 16*a*–16*d* of the inline skate. In the preferred embodiment, the inline skate has four wheels 16*a*–16*d*, arranged sequentially in a line from the front to the rear of the mounting bracket, as clearly shown in FIGS. 1–4 and FIG. 6. Each wheel is connected to one tab 20 of either flex beam 14R or flex beam 14L. Furthermore, as shown in FIG. 3, wheels 16*a*/16*c* are attached to tabs 20 at opposite ends of flex beam 14L and wheels 16*b*/16*d* are attached to tabs 20 at opposite ends of flex beam 14R.

FIG. 2 shows the preferred embodiment of the inline skate suspension system seen from the same orientation as FIG. 1, but with boot 10 removed and mounting bracket 12 spaced apart from the flex beams, so that both flex beam 14L and flex beam 14R can be seen. From this view, it can be clearly seen that each wheel is attached to a different tab 20 of either flex beam 14R or 14L, such that adjacent wheels are not connected to the same flex beam.

While not shown, it is envisioned that mounting bracket 12 and flex beams 14L and 14R may be formed as an integral unit instead of as separate pieces. Such an integral unit would preferably comprise a high impact fiber reinforced polymer, formed by injection molding or other suitable process. The fiber reinforcement should ensure that the resulting integrally formed flex beams are of sufficient strength and resiliency. The use of such an integral structure is expected to reduce manufacturing costs as well as simplifying the production/assembly process.

FIG. 3 clearly shows how mounting bracket 12, flex beams 14L and 14R, and wheels 16*a*–16*d* are connected to tabs 20, at the ends of flex beams 14L and 14R. Axles 30 pass through tabs 20, then through ball or needle bearings 32, which are disposed within the center of wheels 16*a*–16*d* and are held in place by axle retainers 34. The specific bearings 32 employed is not a critical feature of this invention, since it is contemplated that conventional high quality inline skate wheel and bearing assemblies will be used. Those of ordinary skill in the art will readily understand that a wide variety of wheel bearings and other types of axle assemblies may be connected to tabs 20.

In the preferred embodiment, axles 30 are fabricated of stainless steel. Axle retainers 34 are threaded into the mating threaded orifices provided in each end of axles 30 and can be removed to facilitate maintenance or replacement of wheels 16*a*–16*d* and bearings 32. While not preferred, it is contemplated that axles 30 may be welded to tabs 20. Also, axle retainers 34 may be permanently fastened to axles 30, precluding removal of the wheels from the axles. While permanent connection of the wheel assemblies to flex beams 14L and 14R would not allow for the replacement of the above-described components, this option would likely reduce manufacturing costs. However, it is preferable to employ axles 30 and axle retainers 34 of the type and style used in conventional inline skates, since it is likely that experienced skaters will prefer to be able to replace these components when worn, with off-the-shelf replacements. Those of ordinary skill in the art will readily understand that a variety of different axles 30 and axle retainers 34 may be beneficially employed in the present invention.

FIG. 4 is a side elevation view of the right-hand side of the preferred embodiment of a roller skate in accord with the present invention. From this perspective, it can clearly be seen that wheels 16*a*–16*b* are connected to tabs 20 of flex beam 14 in such a fashion that alternating wheels are connected to different flex beams 14L or 14R. It also can clearly be seen that wheel 16*b* is connected to front tab 20 of right-hand side flex beam 14R. Similarly wheel 16*d* is connected to rear tab 20 of right-hand side flex beam 14R.

The perspective of FIG. 4 also illustrates additional details of mounting bracket 12. Note that an edge 12*a* of side 15R on mounting bracket 12 is angled away from wheel 16d sufficiently to provide substantial clearance when wheel 16*d* deflects under load. Similarly, an edge 12*d* of side 15L on mounting bracket 12 is also angled to provide sufficient clearance for wheel 16*a* when it is deflected under load. Angled surfaces 12*b* and 12*c* (the latter being hidden from view and shown as a dashed line) reduce the mass and weight of mounting bracket 12, and also provide clearance for the deflection of wheel 16*b* and 16*c*, respectively. A web 35 (shown in dashed lines in this Figure because it is hidden from view) connects sides 15L and 15R, providing lateral support the sides and generally strengthening the mounting bracket. FIG. 5 shows web 35 more clearly.

Figure 6:
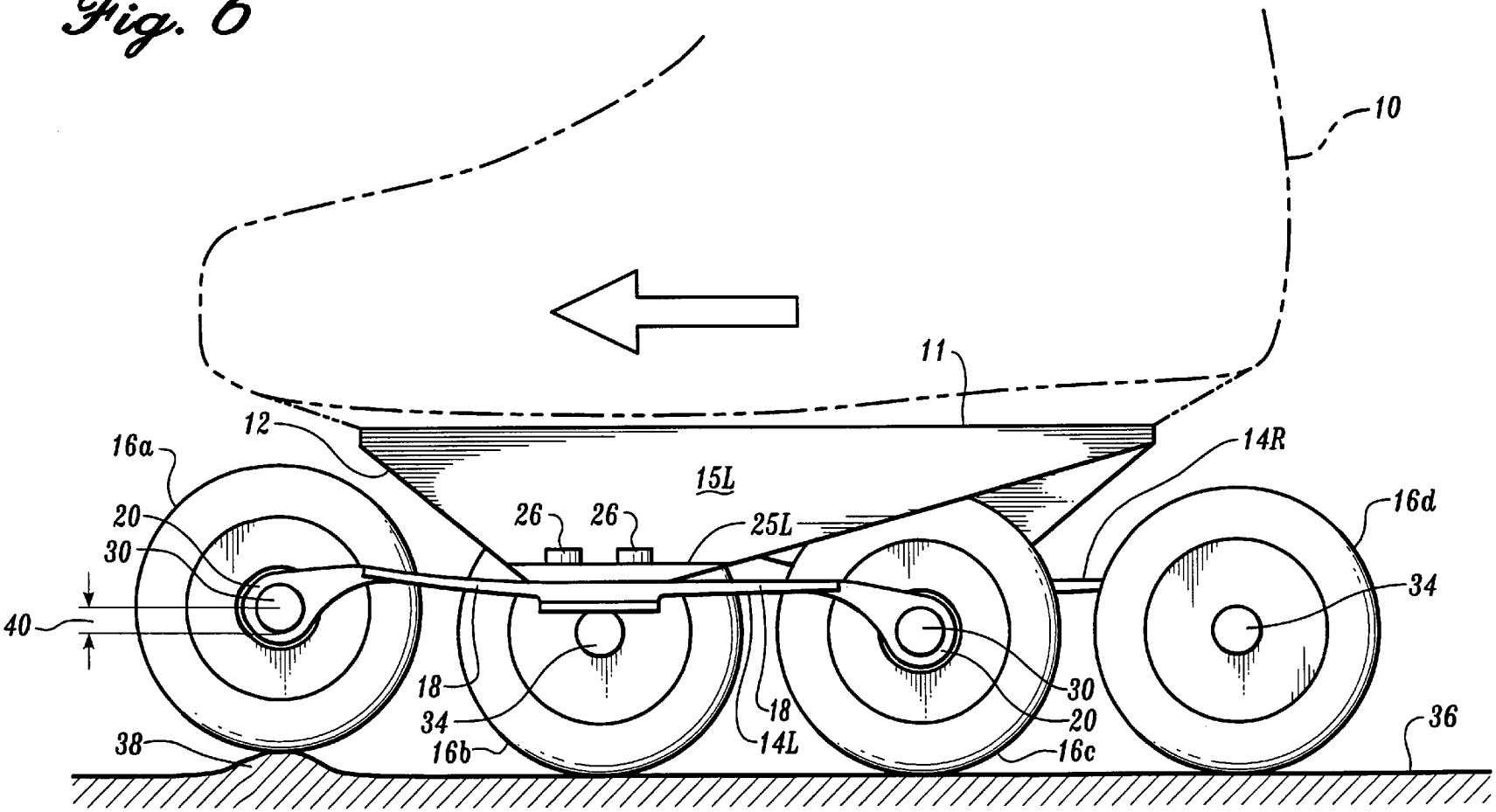
FIG. 6 is a left side elevational view of the suspension system and a boot (depicted in phantom view), illustrating the vertical deflection of a skate wheel and its associated flex beam.

FIG. 6 illustrates how flex beams 14L and 14R allow for the vertical deflection of wheels 16*a*–16*d* to absorb shocks as the wheels roll over a surface 36. In this view, wheel 16*a* is illustrated passing over a bump 38 on surface 36. Forward tab 20 and forward tapered area 18 of flex beam 14L support wheel 16*a*, and are deflected upwardly a distance 40, to allow wheel 16*a* to roll over bump 38. Because wheels 16*a*–16*d* are independently suspended, the end of the flex beams supporting each wheel will successively deflect upwardly as that wheel rolls over bump 38. Because of the shock absorbing deflection that occurs as each wheel encounters bump 38, the skater is NOT subjected to the series of sharp jarring sensations experienced by a skater using conventional inline skates that do not include a suspension system. Instead, the present invention absorbs the shocks of expansion strips, uneven surfaces, pebbles, and other irregular surface features due to the deflections of the flex beams that support the wheels on each skate.

Figure 7:
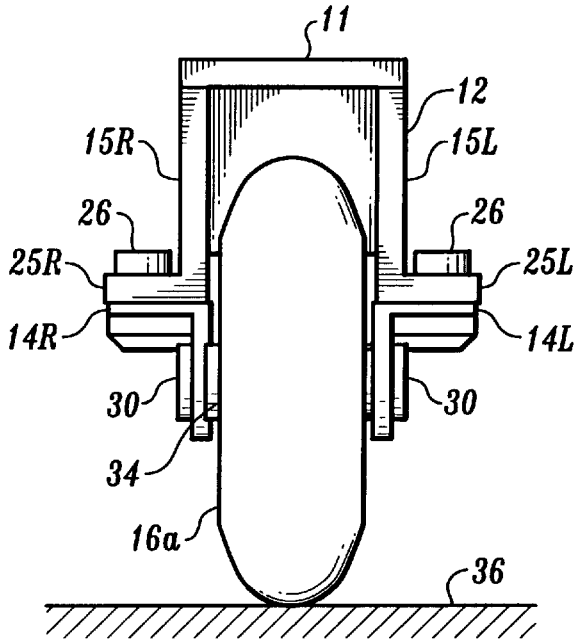
FIG. 7 is a front elevational view of the suspension system, showing a front wheel and its associated flex beam in an undeflected position.
Figure 8:
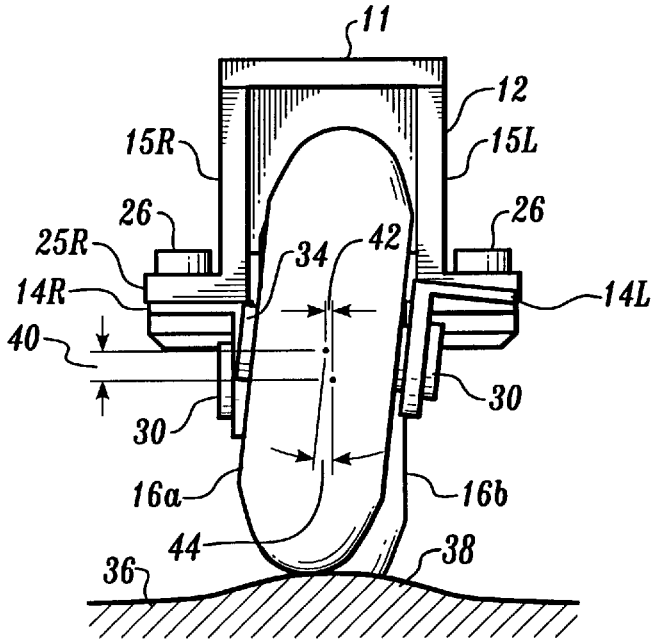
FIG. 8 is a front elevational view of the suspension system, showing a wheel and its associated flex beam deflected vertically, and rotationally about a longitudinal axis of the flex beam.

FIGS. 7 and 8 are to be treated as views of the present invention from a head-on perspective that illustrates another of its features. This view illustrates wheel 16*a* traveling first over a smooth surface (FIG. 7), and then over an irregular surface (FIG. 8) that causes deflection of the forward end of flex beam 14L as wheel 16*a*, the front wheel, rolls over bump 38.

In FIG. 7, wheel 16*a* is shown with the end of the flex beam deflected only minimally, as would be the case when the wheel is rolling over a level surface 36. FIG. 8 shows how the present invention allows for both vertical deflection of wheel 16*a*, as well as a deflection of wheel 16*a* about a longitudinal axis of flex beam 14L, when the wheel encounters bump 38. This bump causes flex beam 14L and wheel 16*a* to deflect upwardly through a vertical distance 40 and to deflect laterally through a distance 42, as the wheel deflects around the longitudinal axis of flex beam 14L through an angle 44. The lateral and angular deflections of flex beam 14L and wheel 16*a* are somewhat exaggerated, to better illustrate the deflections. While not shown, it should be understood that wheels 16*b*–16*d* also deflect through a similar range of motion when the flex beam to which they are attached absorbs the shock as the wheels successively roll over bump 38. It has been found that this slight lateral and angular deflection aids control by the skater for much the same reason that a slight camber of automobile wheels is desirable to facilitate steering control of an automobile. When cornering or riding over bumps, it has been found that the suspension system in accord with the present invention enables the skater to remain in control and to enjoy a level of comfort that has generally not been noted in conventional inline skates without a suspension system.

Although the present invention has been described in connection with the preferred form of practicing it, those of ordinary skill in the art will understand that many modifications can be made thereto within the scope of the claims that follow. Accordingly, it is not intended that the scope of the invention in any way be limited by the above description, but instead be determined entirely by reference to the claims that follow.

The invention in which an exclusive right is claimed is defined by the following:

1. A suspension system for an inline skate, comprising:

(a) a bracket adapted to attach to a boot that receives a user's foot; and (b) a single integral flex beam having a center, and opposite ends extending longitudinally from the center, the center of the flex beam being fixedly connected to said bracket and supported thereby, each end of the flex beam having an axle that is mounted thereon and supported only by the flex beam, each axle having an end that extends laterally to one side of the flex beam and which is adapted to connect with and support a wheel, enabling the wheel to freely rotate about the axle, said ends of the flex beam deflecting to absorb shock when a wheel supported by an end of the flex beam rolls over a bump.

2. The system of claim 1, further comprising another single integral flex beam, said other flex beam having a center and opposite ends extending longitudinally from the center, with the center of said other flex beam being fixedly connected to said bracket and supported thereby, each end of the other flex beam having an axle that is mounted thereon and supported only by the other flex beam, each axle having an end that extends laterally to one side of the other flex beam and which is adapted to connect with and support a wheel, enabling the wheel to freely rotate about the axle, said flex beam and said other flex beam being laterally spaced apart along opposite sides of the bracket, said ends of the other flex beam deflecting to absorb shock when a wheel supported by an end of the other flex beam rolls over a bump.

3. The system of claim 1, wherein the flex beam is fabricated from a metal having predefined elastomeric properties.

4. The system of claim 1, wherein the flex beam is tapered to be thinner at each end to achieve a specified deflection when a defined force is applied to the flex beam.

5. The system of claim 1, wherein said flex beam is removably coupled to the bracket using a fastener.

6. The system of claim 1, wherein the ends of said flex beam deflect vertically to absorb the shock of a wheel rolling over a bump.

7. The system of claim 1, wherein the ends of said flex beam deflect laterally to absorb the shock of a wheel rolling over a bump.

8. The system of claim 1, wherein the ends of said flex beam deflect about a longitudinal axis of the flex beam to absorb the shock of a wheel rolling over a bump.

9. The system of claim 1, wherein the bracket has a side that depends downwardly and wherein the flex beam is attached to the side of the bracket, along a lower edge.

10. The system of claim 1, wherein said bracket and said flex beam are formed as an integral unit.

11. The system of claim 1, wherein the bracket is generally shaped like an inverted "U," with opposite sides, further comprising another flex beam, said flex beam and said other flex beam being mounted to the opposite sides of the bracket.

12. The system of claim 11, wherein each side of the bracket includes a front edge and a rear edge that are angled towards each other along a bottom of the bracket to provide clearance for deflection of the wheels.

13. The system of claim l, wherein the flex beam includes a tab at each end, each tab including an orifice adapted to accept an axle for supporting a wheel.

14. A suspension system for an inline skate having a boot that receives a user's foot, said suspension system comprising:

(a) a mounting bracket having a surface adapted to support a sole of the boot and two opposite sides that depend downwardly from said surface;

(b) a first flex beam that is of a single integral configuration and a second flex beam that is of a single integral configuration, said first flex beam and said second flex beam being fixedly attached adjacent to a lower edge at laterally spaced apart sides of the mounting bracket, each flex beam having two opposite ends, the ends of the first flex beam being longitudinally spaced apart from the ends of the second flex beam along a longitudinal axis of the inline skate; and (c) a plurality of longitudinally spaced apart wheels, each of said plurality of wheels being rotatably mounted in line, on different, longitudinally spaced apart axles, each axle being connected to different ends of the first flex beam and the second flex beam and extending laterally to one side of the first flex beam and laterally to an opposite side of the second flex beam, such that a different wheel is resiliently supported by each different end of the first and the second flex beams, the first and second flex beams deflecting and thereby absorbing shock when the wheels supported by the first and second flex beams roll over a bump.

15. The suspension system of claim 14, wherein said mounting bracket has an inverted "U" shape defined by the surface and sides of the mounting bracket.

16. The suspension system of claim 14, wherein said mounting bracket and said first and second flex beams are formed as an integral unit.

17. The suspension system of claim 14, wherein said first and second flex beams are fabricated from a metal.

18. The suspension system of claim 14, wherein said first and second flex beams are fabricated from a plastic.

19. The suspension system of claim 14, wherein a first and a third wheel are supported by the first flex beam, and a second and a fourth wheel are supported by the second flex beam.

20. The suspension system of claim 14, further comprising a bearing for rotatably mounting a wheel on each axle.

21. The suspension system of claim 14, wherein said first and second flex beams deflect both vertically and horizontally to absorb the shock of a wheel rolling over a bump.

22. The system of claim 14, wherein said first and second flex beams deflect around a longitudinal axis of the first and second flex beams, respectively, when the wheels supported thereby roll over a bump.

23. The system of claim 14, wherein the ends of said first and second flex beams are tapered in thickness to provide a desired degree of deflection.

24. A method for reducing shock and vibration transmitted to a skater when a wheel of an inline skate rolls over a bump, comprising the steps of:

(a) attaching a supporting structure to a sole of the inline skate;

(b) providing a plurality of flex beams, each flex beam being of a single integral configuration, extending along a longitudinal axis and having opposite ends;

(c) fixedly mounting said plurality of flex beams at laterally and longitudinally offset positions along said supporting structure; and (d) mounting a plurality of wheels to the ends of the flex beams on axles that are each supported by only one of the flex beams, so that a different wheel is attached to an axle at each end of said plurality of flex beams at longitudinally spaced apart locations and adjacent wheels are not connected to the same flex beam, said flex beams deflecting to absorb the shock when the wheels roll over a bump.

25. The method of claim 24, further comprising the step of providing clearance between the supporting structure and the plurality of wheels to enable the deflection of the ends of the plurality of flex beams and the plurality of wheels supported thereby.

26. The method of claim 24, wherein the plurality of flex beams deflect both vertically and horizontally as the plurality of wheels roll over a bump.

27. The method of claim 24, wherein the longitudinal axes of said plurality of flex beams extend generally parallel to a direction along which said wheels are rolling.

28. The method of claim 24, wherein the supporting structure and the plurality of flex beam are formed as an integral unit.

29. The method of claim 26, wherein each of the plurality of flex beams deflects around its longitudinal axis when a wheel supported by the flex beam rolls over a bump.

30. The method of claim 26, further comprising the step of tapering a thickness of the plurality of flex beams adjacent to each end to achieve a desired degree of deflection in response to a deflecting force.

* * * * *